US011628345B2

(12) United States Patent
Monge et al.

(10) Patent No.: US 11,628,345 B2
(45) Date of Patent: Apr. 18, 2023

(54) GOLF TRAINING DEVICE WITH SLING IMPLEMENT

(71) Applicants: Claudio Monge, Monterey Park, CA (US); Elizabeth Monge, Monterey Park, CA (US); Jessica Monge, Monterey Park, CA (US); Lisa Monge, Monterey Park, CA (US)

(72) Inventors: Claudio Monge, Monterey Park, CA (US); Elizabeth Monge, Monterey Park, CA (US); Jessica Monge, Monterey Park, CA (US); Lisa Monge, Monterey Park, CA (US)

( * ) Notice: Subject to any disclaimer, the term of this patent is extended or adjusted under 35 U.S.C. 154(b) by 0 days.

(21) Appl. No.: 17/197,899

(22) Filed: Mar. 10, 2021

(65) Prior Publication Data

US 2022/0126185 A1 Apr. 28, 2022

Related U.S. Application Data

(63) Continuation-in-part of application No. 16/245,234, filed on Jan. 10, 2019, now abandoned.

(51) Int. Cl.
*A63B 69/36* (2006.01)
*A63B 69/00* (2006.01)

(52) U.S. Cl.
CPC ..... *A63B 69/0079* (2013.01); *A63B 69/3655* (2013.01)

(58) Field of Classification Search
CPC ..... A63B 69/0079; A63B 69/3655
USPC ..... 473/139, 142, 143, 144, 145, 147, 149, 473/223, 409
See application file for complete search history.

(56) References Cited

U.S. PATENT DOCUMENTS 883,058 A * 3/1908 Sprague
2,514,093 A * 7/1950 Royston ..... A63B 69/0079 473/147
3,051,491 A * 8/1962 Cabot ..... A63B 43/007 473/147
3,767,198 A * 10/1973 Boyer ..... A63B 69/0079 473/423
4,174,107 A * 11/1979 Hickey ..... A63B 69/0079 220/375
4,660,835 A * 4/1987 Locurto ..... A63B 69/0079 473/147
5,072,937 A * 12/1991 Zarate ..... A63B 69/0084 473/426
5,460,380 A * 10/1995 Ober ..... A63B 69/0079 273/147
6,142,889 A * 11/2000 Schaubach ..... A63B 69/0079 473/424

(Continued)

*Primary Examiner* — Nini F Legesse
(74) *Attorney, Agent, or Firm* — Ariel S. Bentolila; Bay Area IP Group, LLC

(57) ABSTRACT

A device including a golf ball that is configured to be operable for golf hitting practice. A cable assembly retains the golf ball during the golf hitting practice. A golf ball attachment eye segment engages the golf ball. A first compression sleeve is configured to join a portion of said cable assembly that is forming the golf ball attachment eye engaged with the golf ball. A cable eye segment is configured to be operable for engaging a stationary object. And a second compression sleeve is configured to join a portion of said cable assembly that is forming said cable eye.

20 Claims, 13 Drawing Sheets

(56) References Cited

U.S. PATENT DOCUMENTS

| | | | | |
|---|---|---|---|---|
| 6,569,026 | B1 * | 5/2003 | Weis | A63B 69/3661 473/278 |
| 8,562,450 | B2 * | 10/2013 | Gormley | A63B 43/007 473/146 |
| 9,682,300 | B2 * | 6/2017 | Connors | A63B 69/0079 |
| 2012/0142442 | A1 * | 6/2012 | Brantingham | A63B 24/0021 473/140 |

* cited by examiner

GOLF TRAINING DEVICE WITH SLING IMPLEMENT

CROSS-REFERENCE TO RELATED APPLICATIONS

The present continuation-in-part patent application claims priority benefit under 35 U.S.C. 120 of the U.S. nonprovisional patent application Ser. No. 16/245,234 entitled "Golf Training Device" filed on 10 Jan. 2019. The contents of this/these related patent application(s) is/are incorporated herein by reference for all purposes to the extent that such subject matter is not inconsistent herewith or limiting hereof.

RELATED CO-PENDING U.S. PATENT APPLICATIONS

Not applicable.

INCORPORATION BY REFERENCE OF SEQUENCE LISTING PROVIDED AS A TEXT FILE

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection by the author thereof. The copyright owner has no objection to the facsimile reproduction by anyone of the patent document or patent disclosure for the purposes of referencing as patent prior art, as it appears in the Patent and Trademark Office, patent file or records, but otherwise reserves all copyright rights whatsoever.

BACKGROUND OF THE RELEVANT PRIOR ART

One or more embodiments of the invention generally relate to golf training aids. More particularly, certain embodiments of the invention relate to a golf training device for practicing golf swings.

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

While playing golf, practicing proper form is one essential aspect of the sport. For many players, it may not always be practical to visit a golf course every time they want to practice their swing. Golf training aids may increase the accessibility of golf by allowing a player to practice their golf technique while the player does not have access to a golf course. Further, a golf training aid may assist a player in learning the correct form for a proper full swing.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that typical golf training aids comprise a golf mat attached to a ball via a rope, bungee cord, and/or paracord. In many scenarios, such products require a large amount of open space, and many additionally may be only used outdoors. The use of plastic or rubber balls may also not perfectly mimic the weight and feel of a real golf ball and may wear down quickly over time. Other examples of golf training aids utilize a metal or plastic frame to hang a golf ball from. While such golf training aids may be useful, they do not offer a very realistic golfing experience.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which.

Figure 1A:
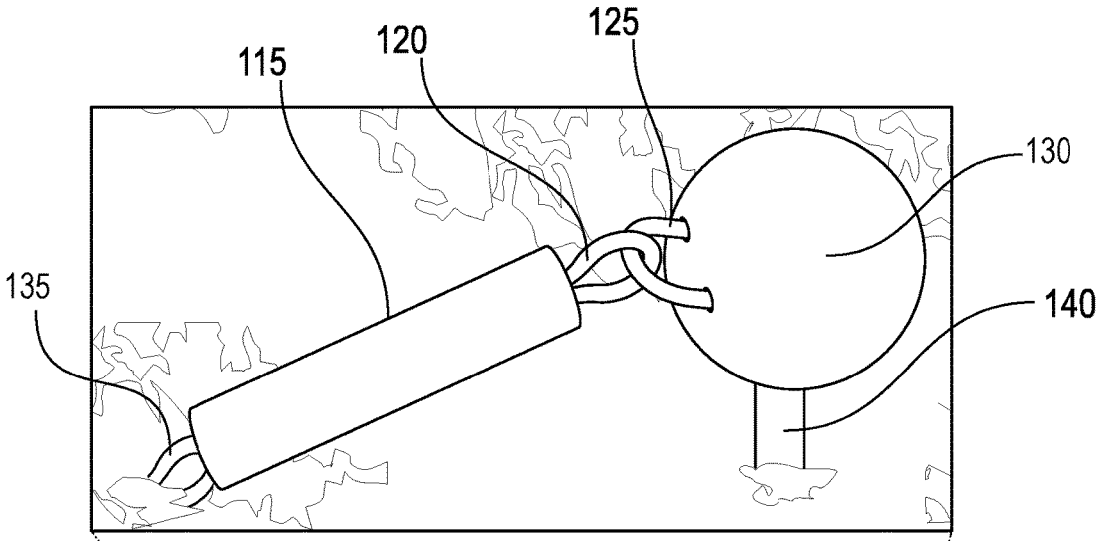
FIG. 1A-1B illustrates an exemplary golf training device, in accordance with an embodiment of the present invention.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

All words of approximation as used in the present disclosure and claims should be construed to mean "approximate," rather than "perfect," and may accordingly be employed as a meaningful modifier to any other word, specified parameter, quantity, quality, or concept. Words of approximation, include, yet are not limited to terms such as "substantial", "nearly", "almost", "about", "generally", "largely", "essentially", "closely approximate", etc.

As will be established in some detail below, it is well settled law, as early as 1939, that words of approximation are not indefinite in the claims even when such limits are not defined or specified in the specification.

For example, see Ex parte Mallory, 52 USPQ 297, 297 (Pat. Off. Bd. App. 1941) where the court said "The examiner has held that most of the claims are inaccurate because apparently the laminar film will not be entirely eliminated. The claims specify that the film is "substantially" eliminated and for the intended purpose, it is believed that the slight portion of the film which may remain is negligible. We are of the view, therefore, that the claims may be regarded as sufficiently accurate."

Note that claims need only "reasonably apprise those skilled in the art" as to their scope to satisfy the definiteness requirement. See Energy Absorption Sys., Inc. v. Roadway Safety Servs., Inc., Civ. App. 96-1264, slip op. at 10 (Fed. Cir. Jul. 3, 1997) (unpublished) Hybridtech v. Monoclonal Antibodies, Inc., 802 F.2d 1367, 1385, 231 USPQ 81, 94 (Fed. Cir. 1986), cert. denied, 480 U.S. 947 (1987). In addition, the use of modifiers in the claim, like "generally" and "substantial," does not by itself render the claims indefinite. See Seattle Box Co. v. Industrial Crating & Packing, Inc., 731 F.2d 818, 828-29, 221 USPQ 568, 575-76 (Fed. Cir. 1984).

Moreover, the ordinary and customary meaning of terms like "substantially" includes "reasonably close to nearly, almost, about", connoting a term of approximation. See In re Frye, Appeal No. 2009-006013, 94 USPQ2d 1072, 1077, 2010 WL 889747 (B.P.A.I. 2010) Depending on its usage, the word "substantially" can denote either language of approximation or language of magnitude. Deering Precision Instruments, L.L.C. v. Vector Distribution Sys., Inc., 347 F.3d 1314, 1323 (Fed. Cir. 2003) (recognizing the "dual ordinary meaning of th[e] term ["substantially"] as connoting a term of approximation or a term of magnitude"). Here, when referring to the "substantially halfway" limitation, the Specification uses the word "approximately" as a substitute for the word "substantially" (Fact 4). (Fact 4). The ordinary meaning of "substantially halfway" is thus reasonably close to or nearly at the midpoint between the forwardmost point of the upper or outsole and the rearward most point of the upper or outsole.

Similarly, the term 'substantially' is well recognized in case law to have the dual ordinary meaning of connoting a term of approximation or a term of magnitude. See Dana Corp. v. American Axle & Manufacturing, Inc., Civ. App. 04-1116, 2004 U.S. App. LEXIS 18265, *13-14 (Fed. Cir. Aug. 27, 2004) (unpublished). The term "substantially" is commonly used by claim drafters to indicate approximation. See Cordis Corp. v. Medtronic AVE Inc., 339 F.3d 1352, 1360 (Fed. Cir. 2003) ("The patents do not set out any numerical standard by which to determine whether the thickness of the wall surface is 'substantially uniform.' The term 'substantially,' as used in this context, denotes approximation. Thus, the walls must be of largely or approximately uniform thickness."); see also Deering Precision Instruments, LLC v. Vector Distribution Sys., Inc., 347 F.3d 1314, 1322 (Fed. Cir. 2003); Epcon Gas Sys., Inc. v. Bauer Compressors, Inc., 279 F.3d 1022, 1031 (Fed. Cir. 2002). We find that the term "substantially" was used in just such a manner in the claims of the patents-in-suit: "substantially uniform wall thickness" denotes a wall thickness with approximate uniformity.

It should also be noted that such words of approximation as contemplated in the foregoing clearly limits the scope of claims such as saying 'generally parallel' such that the adverb 'generally' does not broaden the meaning of parallel. Accordingly, it is well settled that such words of approximation as contemplated in the foregoing (e.g., like the phrase 'generally parallel') envisions some amount of deviation from perfection (e.g., not exactly parallel), and that such words of approximation as contemplated in the foregoing are descriptive terms commonly used in patent claims to avoid a strict numerical boundary to the specified parameter. To the extent that the plain language of the claims relying on such words of approximation as contemplated in the foregoing are clear and uncontradicted by anything in the written description herein or the figures thereof, it is improper to rely upon the present written description, the figures, or the prosecution history to add limitations to any of the claim of the present invention with respect to such words of approximation as contemplated in the foregoing. That is, under such circumstances, relying on the written description and prosecution history to reject the ordinary and customary meanings of the words themselves is impermissible. See, for example, Liquid Dynamics Corp. v. Vaughan Co., 355 F.3d 1361, 69 USPQ2d 1595, 1600-01 (Fed. Cir. 2004). The plain language of phrase 2 requires a "substantial helical flow." The term "substantial" is a meaningful modifier implying "approximate," rather than "perfect." In Cordis Corp. v. Medtronic AVE, Inc., 339 F.3d 1352, 1361 (Fed. Cir. 2003), the district court imposed a precise numeric constraint on the term "substantially uniform thickness." We noted that the proper interpretation of this term was "of largely or approximately uniform thickness" unless something in the prosecution history imposed the "clear and unmistakable disclaimer" needed for narrowing beyond this simple-language interpretation. Id. In Anchor Wall Systems v. Rockwood Retaining Walls, Inc., 340 F.3d 1298, 1311 (Fed. Cir. 2003)" Id. at 1311. Similarly, the plain language of claim 1 requires neither a perfectly helical flow nor a flow that returns precisely to the center after one rotation (a limitation that arises only as a logical consequence of requiring a perfectly helical flow).

The reader should appreciate that case law generally recognizes a dual ordinary meaning of such words of approximation, as contemplated in the foregoing, as connoting a term of approximation or a term of magnitude; e.g., see Deering Precision Instruments, L.L.C. v. Vector Distrib. Sys., Inc., 347 F.3d 1314, 68 USPQ2d 1716, 1721 (Fed. Cir. 2003), cert. denied, 124 S. Ct. 1426 (2004) where the court was asked to construe the meaning of the term "substantially" in a patent claim. Also see Epcon, 279 F.3d at 1031 ("The phrase 'substantially constant' denotes language of approximation, while the phrase 'substantially below' signifies language of magnitude, i.e., not insubstantial."). Also, see, e.g., Epcon Gas Sys., Inc. v. Bauer Compressors, Inc., 279 F.3d 1022 (Fed. Cir. 2002) (construing the terms "substantially constant" and "substantially below"); Zodiac Pool Care, Inc. v. Hoffinger Indus., Inc., 206 F.3d 1408 (Fed. Cir. 2000) (construing the term "substantially inward"); York Prods., Inc. v. Cent. Tractor Farm & Family Ctr., 99 F.3d 1568 (Fed. Cir. 1996) (construing the term "substantially the entire height thereof"); Tex. Instruments Inc. v. Cypress Semiconductor Corp., 90 F.3d 1558 (Fed. Cir. 1996) (construing the term "substantially in the common plane"). In conducting their analysis, the court instructed to begin with the ordinary meaning of the claim terms to one of ordinary skill in the art. Prima Tek, 318 F.3d at 1148. Reference to dictionaries and our cases indicates that the term "substantially" has numerous ordinary meanings. As the district court stated, "substantially" can mean "significantly" or "considerably." The term "substantially" can also mean "largely" or "essentially." Webster's New 20th Century Dictionary 1817 (1983).

Words of approximation, as contemplated in the foregoing, may also be used in phrases establishing approximate ranges or limits, where the end points are inclusive and approximate, not perfect; e.g., see AK Steel Corp. v. Sollac, 344 F.3d 1234, 68 USPQ2d 1280, 1285 (Fed. Cir. 2003) where it where the court said [W]e conclude that the ordinary meaning of the phrase "up to about 10%" includes the "about 10%" endpoint. As pointed out by AK Steel, when an object of the preposition "up to" is nonnumeric, the most natural meaning is to exclude the object (e.g., painting the wall up to the door). On the other hand, as pointed out by Sollac, when the object is numerical limit, the normal meaning is to include that upper numerical limit (e.g., counting up to ten, seating capacity for up to seven passengers). Because we have here a numerical limit—"about 10%"—the ordinary meaning is that that endpoint is included.

In the present specification and claims, a goal of employment of such words of approximation, as contemplated in the foregoing, is to avoid a strict numerical boundary to the modified specified parameter, as sanctioned by Pall Corp. v. Micron Separations, Inc., 66 F.3d 1211, 1217, 36 USPQ2d 1225, 1229 (Fed. Cir. 1995) where it states "It is well established that when the term "substantially" serves reasonably to describe the subject matter so that its scope would be understood by persons in the field of the invention, and to distinguish the claimed subject matter from the prior art, it is not indefinite." Likewise see Verve LLC v. Crane Cams Inc., 311 F.3d 1116, 65 USPQ2d 1051, 1054 (Fed. Cir. 2002). Expressions such as "substantially" are used in patent documents when warranted by the nature of the invention, in order to accommodate the minor variations that may be appropriate to secure the invention. Such usage may well satisfy the charge to "particularly point out and distinctly claim" the invention, 35 U.S.C. § 112, and indeed may be necessary in order to provide the inventor with the benefit of his invention. In Andrew Corp. v. Gabriel Elecs. Inc., 847 F.2d 819, 821-22, 6 USPQ2d 2010, 2013 (Fed. Cir. 1988) the court explained that usages such as "substantially equal" and "closely approximate" may serve to describe the invention with precision appropriate to the technology and without intruding on the prior art. The court again explained in Ecolab Inc. v. Envirochem, Inc., 264 F.3d 1358, 1367, 60 USPQ2d 1173, 1179 (Fed. Cir. 2001) that "like the term 'about,' the term 'substantially' is a descriptive term commonly used in patent claims to 'avoid a strict numerical boundary to the specified parameter, see Ecolab Inc. v. Envirochem Inc., 264 F.3d 1358, 60 USPQ2d 1173, 1179 (Fed. Cir. 2001) where the court found that the use of the term "substantially" to modify the term "uniform" does not render this phrase so unclear such that there is no means by which to ascertain the claim scope.

Similarly, other courts have noted that like the term "about," the term "substantially" is a descriptive term commonly used in patent claims to "avoid a strict numerical boundary to the specified parameter."; e.g., see Pall Corp. v. Micron Seps., 66 F.3d 1211, 1217, 36 USPQ2d 1225, 1229 (Fed. Cir. 1995); see, e.g., Andrew Corp. v. Gabriel Elecs. Inc., 847 F.2d 819, 821-22, 6 USPQ2d 2010, 2013 (Fed. Cir. 1988) (noting that terms such as "approach each other," "close to," "substantially equal," and "closely approximate" are ubiquitously used in patent claims and that such usages, when serving reasonably to describe the claimed subject matter to those of skill in the field of the invention, and to distinguish the claimed subject matter from the prior art, have been accepted in patent examination and upheld by the courts). In this case, "substantially" avoids the strict 100% nonuniformity boundary.

Indeed, the foregoing sanctioning of such words of approximation, as contemplated in the foregoing, has been established as early as 1939, see Ex parte Mallory, 52 USPQ 297, 297 (Pat. Off. Bd. App. 1941) where, for example, the court said "the claims specify that the film is "substantially" eliminated and for the intended purpose, it is believed that the slight portion of the film which may remain is negligible. We are of the view, therefore, that the claims may be regarded as sufficiently accurate." Similarly, In re Hutchison, 104 F.2d 829, 42 USPQ 90, 93 (C.C.P.A. 1939) the court said, "It is realized that "substantial distance" is a relative and somewhat indefinite term, or phrase, but terms and phrases of this character are not uncommon in patents in cases where, according to the art involved, the meaning can be determined with reasonable clearness."

Hence, for at least the forgoing reason, Applicants submit that it is improper for any examiner to hold as indefinite any claims of the present patent that employ any words of approximation.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will be described in detail below with reference to embodiments thereof as illustrated in the accompanying drawings.

References to a "device," an "apparatus," a "system," etc., in the preamble of a claim should be construed broadly to mean "any structure meeting the claim terms" exempt for any specific structure(s)/type(s) that has/(have) been explicitly disavowed or excluded or admitted/implied as prior art in the present specification or incapable of enabling an object/aspect/goal of the invention. Furthermore, where the present specification discloses an object, aspect, function, goal, result, or advantage of the invention that a specific prior art structure and/or method step is similarly capable of performing yet in a very different way, the present invention disclosure is intended to and shall also implicitly include and cover additional corresponding alternative embodiments that are otherwise identical to that explicitly disclosed except that they exclude such prior art structure(s)/step(s), and shall accordingly be deemed as providing sufficient disclosure to support a corresponding negative limitation in a claim claiming such alternative embodiment(s), which exclude such very different prior art structure(s)/step(s) way(s).

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable sub combination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," "some embodiments," "embodiments of the invention," etc., may indicate that the embodiment(s) of the invention so described may include a particular feature, structure, or characteristic, but not every possible embodiment of the invention necessarily includes the particular feature, structure, or characteristic. Further, repeated use of the phrase "in one embodiment," or "in an exemplary embodiment," "an embodiment," do not necessarily refer to the same embodiment, although they may. Moreover, any use of phrases like "embodiments" in connection with "the invention" are never meant to characterize that all embodiments of the invention must include the particular feature, structure, or characteristic, and should instead be understood to mean "at least some embodiments of the invention" include the stated particular feature, structure, or characteristic.

References to "user", or any similar term, as used herein, may mean a human or non-human user thereof. Moreover, "user", or any similar term, as used herein, unless expressly stipulated otherwise, is contemplated to mean users at any stage of the usage process, to include, without limitation, direct user(s), intermediate user(s), indirect user(s), and end user(s). The meaning of "user", or any similar term, as used herein, should not be otherwise inferred, or induced by any pattern(s) of description, embodiments, examples, or referenced prior art that may (or may not) be provided in the present patent.

References to "end user", or any similar term, as used herein, is generally intended to mean late-stage user(s) as opposed to early-stage user(s). Hence, it is contemplated that there may be a multiplicity of different types of "end user" near the end stage of the usage process. Where applicable, especially with respect to distribution channels of embodiments of the invention comprising consumed retail products/services thereof (as opposed to sellers/vendors or Original Equipment Manufacturers), examples of an "end user" may include, without limitation, a "consumer", "buyer", "customer", "purchaser", "shopper", "enjoyer", "viewer", or individual person or non-human thing benefiting in any way, directly or indirectly, from use of. or interaction, with some aspect of the present invention.

In some situations, some embodiments of the present invention may provide beneficial usage to more than one stage or type of usage in the foregoing usage process. In such cases where multiple embodiments targeting various stages of the usage process are described, references to "end user", or any similar term, as used therein, are generally intended to not include the user that is the furthest removed, in the foregoing usage process, from the final user therein of an embodiment of the present invention.

Where applicable, especially with respect to retail distribution channels of embodiments of the invention, intermediate user(s) may include, without limitation, any individual person or non-human thing benefiting in any way, directly or indirectly, from use of, or interaction with, some aspect of the present invention with respect to selling, vending, Original Equipment Manufacturing, marketing, merchandising, distributing, service providing, and the like thereof.

References to "person", "individual", "human", "a party", "animal", "creature", or any similar term, as used herein, even if the context or particular embodiment implies living user, maker, or participant, it should be understood that such characterizations are sole by way of example, and not limitation, in that it is contemplated that any such usage, making, or participation by a living entity in connection with making, using, and/or participating, in any way, with embodiments of the present invention may be substituted by such similar performed by a suitably configured non-living entity, to include, without limitation, automated machines, robots, humanoids, computational systems, information processing systems, artificially intelligent systems, and the like. It is further contemplated that those skilled in the art will readily recognize the practical situations where such living makers, users, and/or participants with embodiments of the present invention may be in whole, or in part, replaced with such non-living makers, users, and/or participants with embodiments of the present invention. Likewise, when those skilled in the art identify such practical situations where such living makers, users, and/or participants with embodiments of the present invention may be in whole, or in part, replaced with such non-living makers, it will be readily apparent in light of the teachings of the present invention how to adapt the described embodiments to be suitable for such non-living makers, users, and/or participants with embodiments of the present invention. Thus, the invention is thus to also cover all such modifications, equivalents, and alternatives falling within the spirit and scope of such adaptations and modifications, at least in part, for such non-living entities.

Headings provided herein are for convenience and are not to be taken as limiting the disclosure in any way.

The enumerated listing of items does not imply that any or all of the items are mutually exclusive, unless expressly specified otherwise.

It is understood that the use of specific component, device and/or parameter names are for example only and not meant to imply any limitations on the invention. The invention may thus be implemented with different nomenclature/terminology utilized to describe the mechanisms/units/structures/components/devices/parameters herein, without limitation. Each term utilized herein is to be given its broadest interpretation given the context in which that term is utilized.

Terminology. The following paragraphs provide definitions and/or context for terms found in this disclosure (including the appended claims):

"Comprising" And "contain" and variations of them—Such terms are open-ended and mean "including but not limited to". When employed in the appended claims, this term does not foreclose additional structure or steps. Consider a claim that recites: "A memory controller comprising a system cache . . . . " Such a claim does not foreclose the memory controller from including additional components (e.g., a memory channel unit, a switch).

"Configured To." Various units, circuits, or other components may be described or claimed as "configured to" perform a task or tasks. In such contexts, "configured to" or "operable for" is used to connote structure by indicating that the mechanisms/units/circuits/components include structure (e.g., circuitry and/or mechanisms) that performs the task or tasks during operation. As such, the mechanisms/unit/circuit/component can be said to be configured to (or be operable) for perform(ing) the task even when the specified mechanisms/unit/circuit/component is not currently operational (e.g., is not on). The mechanisms/units/circuits/components used with the "configured to" or "operable for" language include hardware—for example, mechanisms, structures, electronics, circuits, memory storing program instructions executable to implement the operation, etc. Reciting that a mechanism/unit/circuit/component is "configured to" or "operable for" perform(ing) one or more tasks is expressly intended not to invoke 35 U.S.C. sctn.112, sixth paragraph, for that mechanism/unit/circuit/component. "Configured to" may also include adapting a manufacturing process to fabricate devices or components that are adapted to implement or perform one or more tasks.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While B may be a factor that affects the determination of A, such a phrase does not foreclose the determination of A from also being based on C. In other instances, A may be determined based solely on B.

The terms "a", "an" and "the" mean "one or more", unless expressly specified otherwise.

All terms of exemplary language (e.g., including, without limitation, "such as", "like", "for example", "for instance", "similar to", etc.) are not exclusive of any other, potentially, unrelated, types of examples; thus, implicitly mean "by way of example, and not limitation . . . ", unless expressly specified otherwise.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phase "consisting essentially of" and "consisting of" limits the scope of a claim to the specified elements or method steps, plus, those that do not materially affect the basis and novel characteristic(s) of the claimed subject matter (see Norian Corp. v Stryker Corp., 363 F.3d 1321, 1331-32, 70 USPQ2d 1508, Fed. Cir. 2004). Moreover, for any claim of the present invention which claims an embodiment "consisting essentially of" or "consisting of" a certain set of elements of any herein described embodiment it shall be understood as obvious by those skilled in the art that the present invention also covers all possible varying scope variants of any described embodiment(s) that are each exclusively (i.e., "consisting essentially of") functional subsets or functional combination thereof such that each of these plurality of exclusive varying scope variants each consists essentially of any functional subset(s) and/or functional combination(s) of any set of elements of any described embodiment(s) to the exclusion of any others not set forth therein. That is, it is contemplated that it will be obvious to those skilled how to create a multiplicity of alternate embodiments of the present invention that simply consisting essentially of a certain functional combination of elements of any described embodiment(s) to the exclusion of any others not set forth therein, and the invention thus covers all such exclusive embodiments as if they were each described herein.

With respect to the terms "comprising," "consisting of," and "consisting essentially of," where one of these three terms is used herein, the disclosed and claimed subject matter may include the use of either of the other two terms. Thus, in some embodiments not otherwise explicitly recited, any instance of "comprising" may be replaced by "consisting of" or, alternatively, by "consisting essentially of", and thus, for the purposes of claim support and construction for "consisting of" format claims, such replacements operate to create yet other alternative embodiments "consisting essentially of" only the elements recited in the original "comprising" embodiment to the exclusion of all other elements.

Moreover, any claim limitation phrased in functional limitation terms covered by 35 USC § 112(6) (post AIA 112(f)) which has a preamble invoking the closed terms "consisting of," or "consisting essentially of," should be understood to mean that the corresponding structure(s) disclosed herein define the exact metes and bounds of what the so claimed invention embodiment(s) consists of, or consisting essentially of, to the exclusion of any other elements which do not materially affect the intended purpose of the so claimed embodiment(s).

Devices or system modules that are in at least general communication with each other need not be in continuous communication with each other, unless expressly specified otherwise. In addition, devices or system modules that are in at least general communication with each other may communicate directly or indirectly through one or more intermediaries. Moreover, it is understood that any system components described or named in any embodiment or claimed herein may be grouped or sub-grouped (and accordingly implicitly renamed) in any combination or sub-combination as those skilled in the art can imagine as suitable for the particular application, and still be within the scope and spirit of the claimed embodiments of the present invention. For an example of what this means, if the invention was a controller of a motor and a valve and the embodiments and claims articulated those components as being separately grouped and connected, applying the foregoing would mean that such an invention and claims would also implicitly cover the valve being grouped inside the motor and the controller being a remote controller with no direct physical connection to the motor or internalized valve, as such the claimed invention is contemplated to cover all ways of grouping and/or adding of intermediate components or systems that still substantially achieve the intended result of the invention.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

Some embodiments of the present invention and variations thereof, relate to golf training aids. In one embodiment of the present invention, the golf training device provides a golfer a way to practice their golf swing daily indoor. The golf training device is a practice aid placed on the ground to use. A user may practice golf swings off a golf ball tee. By flipping a golf ball over to an opposite side, the user may then swing of a grass turf. The device is a dual golf swing practice aid where a user may practice swinging on the golf ball, or a user may practice swinging on the grass turf. Nothing to build or tear down when finished. It may simply be picking up the device and storing it away.

In one embodiment, the golf training device comprises a grass turf segment spread over a rubber sheet, a sling implement attached to a golf ball, a golf ball tee disposed on a side portion of the grass turf, an eye strap, a sling protection tubing, and a golf ball fastener. The grass turf segment may include but not limited to artificial or synthetic Rye grass. The rubber sheet may include but not limited to a rubber sheet, a PVC base or a plywood base. The eye strap may include but not limited to a flat steel eye strap, round eye straps or eye straps made of other types of metal. The golf ball fastener may include, but not limited to, a steel double barbed U-shaped golf ball fastener. The double barb may engage the inside of the solid core golf ball to add an extra grip. Additional barbs may be added to further strengthen the fasteners grip on the golf ball. The sling implement may include, but not limited to, a galvanized wire rope, a pair of thimbles, and compression sleeves. A thimble eye is formed at each end portion of the wire rope held with the compression sleeve. One thimble eye end is for connecting the sling implement to a golf ball. The other thimble eye end is for connecting the sling implement to the steel flat eye strap and the rubber sheet. The other thimble eye end may be anchored to the middle of the rubber sheet by the steel flat eye strap. The other thimble eye end may allow the attached golf ball to be flexible during use. The tubing generally encloses the sling implement to protect the sling implement during practice. The tubing may include but not limited to, vinyl, PVC, rubber, etc. The golf ball may be attached to the one thimble eye end with the golf ball fastener. The golf ball attached to the one thimble eye end may be angled during use so the golf club will hit more of the golf ball than the tubing protecting the sling. The other thimble eye end may allow the golf ball rotation while being held by the steel flat eye strap to the rubber sheet. In some embodiments, a proximately six (6) inch or longer sling may allow the golf ball to rotate inside a proximately eight (8) inch or more diameter of the grass turf. The thimble eye on both ends may protect the cable from fraying due to the golf ball's circular rotation after being struck. In one embodiment, the sling implement includes a single cable wire in the middle with thimble eyes on both ends of the cable held by the compression sleeves. In another embodiment, the end points of the cable wire meet in the middle of the wire and held with a compression sleeve. In effect, a dual strand sling implement may be created. This may add strength to the middle of the sling implement by joining the two cables. In some embodiments, the sling implement comprises, but not limited to, an approximately ⅛"×6" 7×19 galvanized wire rope. The sling implement may further comprise, but not limited to, an approximately four (4) to six (6) inch long sling. In alternative embodiments, the sling implement may comprise, nylon rope, bungee cords, chains, etc. The strap may include, but not limited to, a ⅞"×½" stainless steel flat eye strap with a height of about one inch (1"). The approximately one-inch (1") height strap may help the attached thimble eye end rotate with less friction around the strap when the golf ball is struck.

In other embodiments, the height of the strap may be more than one inch in height. The additional height may help the thimble eye end rotate around the strap with less friction when the golf ball is struck. The rubber sheet may be, but not limited to, approximately one-half inch (½") in height. The artificial grass turf top may stiffen the flexibility of the sling. The flat eye strap is pushed up from underneath the rubber sheet and holds the other end of the thimble eye. An approximately ¾" hole may be drilled in the middle of the rubber sheet. One end of the sling inserted into the hole from the top of the rubber sheets. The flat eye strap may then be inserted into the eye hole of the sling an pushed up under the rubber sheet. This typically holds the sling secure to the rubber sheet.

In use, the golf training device is laid on the ground. Set the attached golf ball on the rubber tee. An image of a golf ball lying on grass turf is now presented to a user where the golfer may tee off or hitting of the ruff. The golf ball when hit may do a few circles around the strap before stopping. After which, the golf ball may be reset, and the user may continue practicing teeing off. To practice hitting of the grass turf, the golf ball may be flipped over to the opposite side and the grass turf may be provided for practice. When not in use, simply fold the device and store.

The golf training device is configured to be used from any area that may allow the device to be placed firmly on the ground for a full golf swing. The device may be used in the morning, evening, and night. With the device, practice is now at the golfer's convenience.

The present invention will now be described in detail with reference to embodiments thereof as illustrated in the accompanying drawings.

Figure 1B:
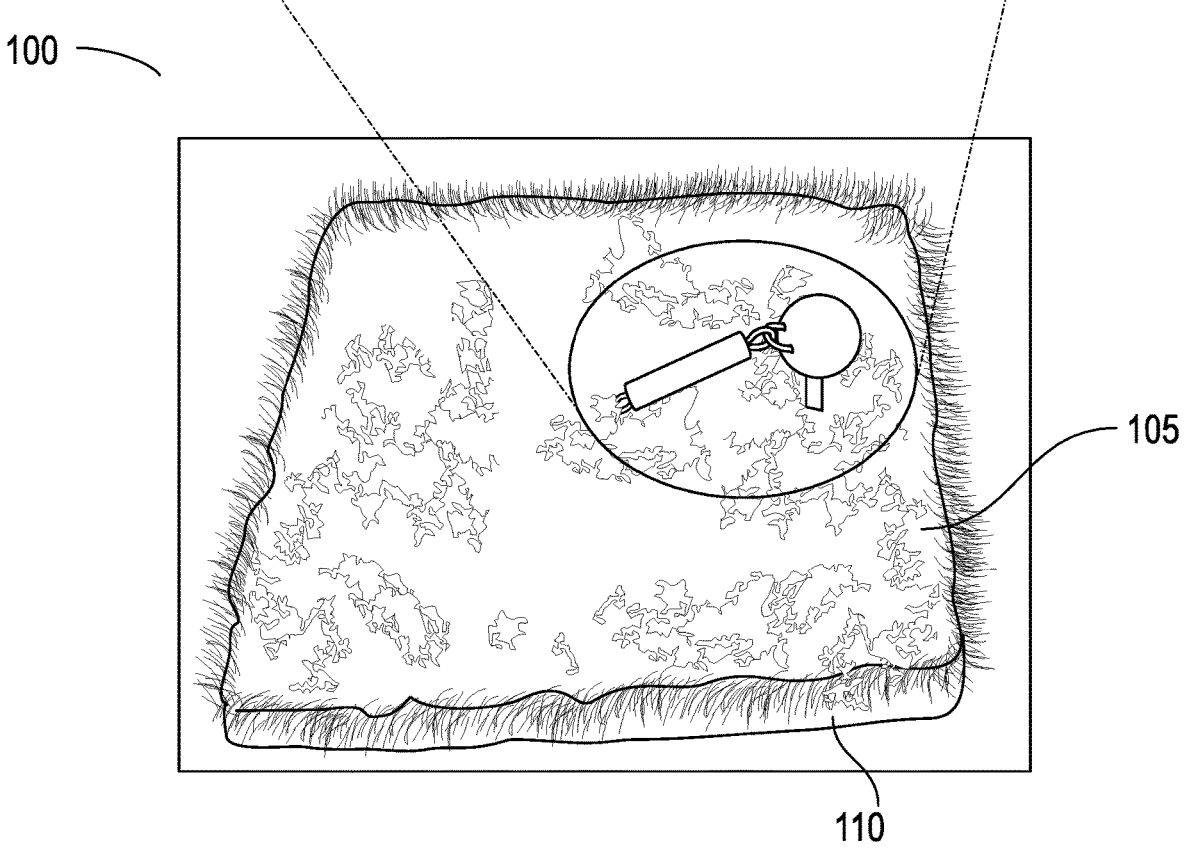

FIG. 1A-1B illustrates an exemplary golf training device 100, in accordance with an embodiment of the present invention. In the present embodiment, FIG. 1B shows an image of the golf training device that is ready for use and FIG. 1A shows a blown-up image of the golf ball setup. In the present embodiment, the golf training device comprises a grass turf segment 105 spread over a rubber sheet 110, a sling implements 120 attached to a golf ball 130, a golf ball tee 140 disposed on a side portion of the grass turf 105, an eye strap 135, a sling protection tubing 115, and a golf ball fastener 125. The grass turf segment 105 may include but not limited to artificial or synthetic Rye grass. The rubber sheet 110 may include but not limited to a rubber sheet. It is contemplated that PVC or plywood bases may be used in alternate embodiments. The eye strap 135 may include but not limited to a flat steel eye strap or eye straps of various other materials. The golf ball fastener 125 may include, but not limited to, a steel double barbed U-shaped golf ball fastener. The double barb may engage the inside of the solid core golf ball to add an extra grip. Additional barbs may be added to further strengthen the fasteners grip on the golf ball. In some embodiments a heavy gauge fence staple with or without barbs may be used as the golf ball fastener. The sling implements 120 may include, but not limited to, a wire rope, a pair of thimbles, and compression sleeves. The wire rope may include but not limited to a galvanized wire rope. A thimble eye is formed at each end portion of the wire rope held with the compression sleeve. One thimble eye end is for connecting the sling implement to a golf ball. The other thimble eye end is for connecting the sling implement 120 to the steel flat eye strap and the rubber sheet. The other thimble eye end may be anchored to the middle of the rubber sheet 110 by the steel flat eye strap 135. The other thimble eye end may allow the attached golf ball 130 to be flexible during use. The tubing 115 generally encloses the sling implement 120 to protect the sling implement 120 during practice. The tubing 115 may include but not limited to, vinyl, PVC, rubber etc. The golf ball 130 may be attached to the one thimble eye end with the golf ball fastener 125. The golf ball 130 attached to the one thimble eye end may be angled during use so the golf club will hit more of the golf ball 130 than the tubing 115 protecting the sling implement 120. The other thimble eye end may allow the golf ball 130 to rotate while being held by the steel flat eye strap 135 to the rubber sheet 110. In some embodiments, an approximately six (6) inch or longer sling may allow the golf ball 130 to rotate inside approximately eight (8) inch or more in diameter of the rubber sheet 110. The thimble eye on both ends may protect the cable from fraying due to the circular rotation of golf ball 130 after being struck. In one embodiment, the sling implement includes a single cable wire in the middle with thimble eyes on both ends of the cable held by the compression sleeves. In another embodiment, the end points of the cable wire meet in the middle of the wire and held with a compression sleeve. In effect, a dual strand sling implement may be created. This may add strength to the middle of the sling implement by joining the two cables. In some embodiments, the sling implement comprises, but not limited to, an approximately ⅛"×6" 7×19 galvanized wire rope. In some embodiments an approximately ¼" wire rope may be used along with a larger thimble. The sling implements 120 may further comprise, but not limited to, an approximately six (6) inch long sling. In alternative embodiments, the sling implement may comprise, nylon rope, bungee cords, chains, etc. The eye strap 135 may include, but not limited to, a ⅞"×½" stainless steel flat eye strap with a height of about one inch (1"). The approximately one-inch (1") height of eye strap 135 may help the attached thimble eye end rotate with less friction around the strap when the golf ball 130 is struck.

Figure 2A:
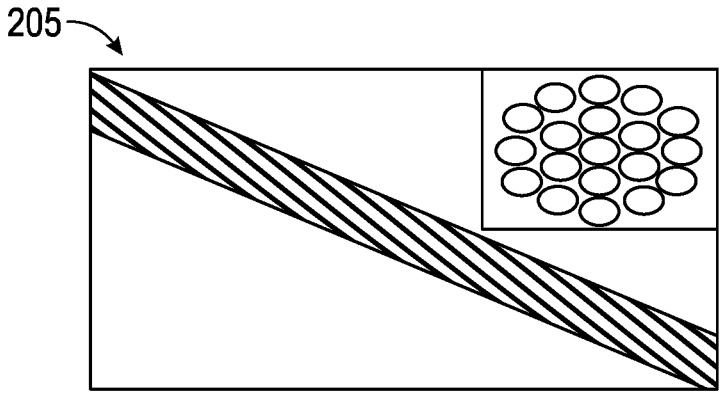
FIG. 2A-FIG. 2C illustrates an exemplary single strand sling implement, in accordance with an embodiment of the present invention.
Figure 2B:
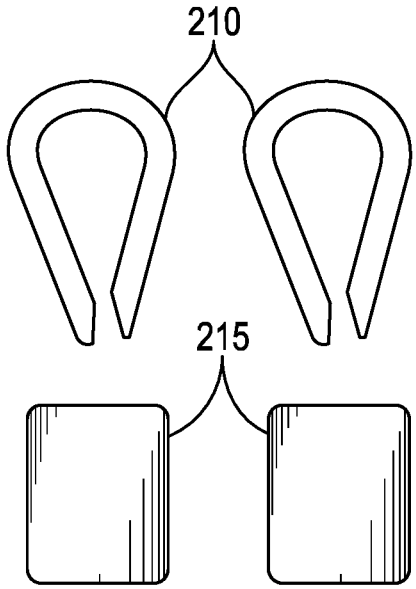
Figure 2C:
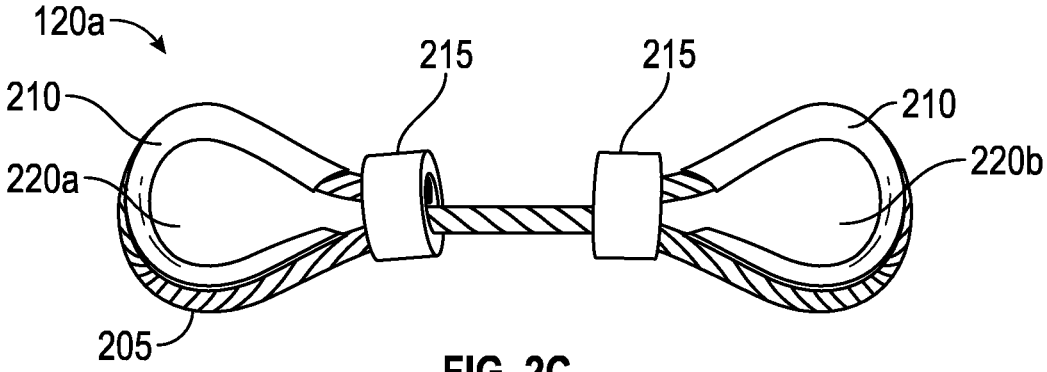

In other embodiments, the height of the strap may be more than one inch in height. The additional height may help the thimble eye end rotate around the strap with less friction when the golf ball is struck. The rubber sheet 110 may be, but not limited to, approximately one-half inch (½") in height. The artificial grass turf segment 140 may stiffen the flexibility of the sling. The flat eye strap 135 is pushed up from underneath the rubber sheet and holds the other end of the thimble eye FIG. 2A-FIG. 2C illustrates an exemplary single strand sling implement 120*a*, in accordance with an embodiment of the present invention. FIG. 2A shows an exemplary wire rope 205. The wire rope 205 may include but not limited to a galvanized wire rope. FIG. 2B shows a pair of exemplary thimbles 210 and a pair of compression sleeves 215. FIG. 2C shows an exemplary assembled single strand sling implement 120*a* where thimble eyes 210 on both ends of the wire rope 205 are held by the compression sleeves 215 with a single wire rope 205*a* in the middle. In the present embodiment shown, the single strand sling implement 120*a* may include but not limited to a single strand wire rope 205*a*, pair of thimbles 210, and pair of compression sleeves 215. A thimble eye 220*a* 220*b* is formed at each end portion of the wire rope 205 held with the compression sleeve 215. One thimble eye end 220*a* is for connecting the single strand sling implement 120*a* to the golf ball 130. The other thimble eye end 220*b* is for connecting the sling implement 120 to the eye strap 135 and the rubber sheet 105. The other thimble eye end 220*b* may be anchored to a middle portion of the rubber sheet 105 by the eye strap 135. The other thimble eye end 220*b* may allow the attached golf ball 130 to be flexible during use. The thimble eye ends 220*a* 220*b* may protect the wire rope 205 from fraying due to the golf ball's circular rotation after being struck. A proximately six (6) inch or longer single strand sling implement 120*a* may allow the golf ball 130 to rotate inside a proximately eight (8) inch or more diameter of the grass turf 105.

Figure 3:
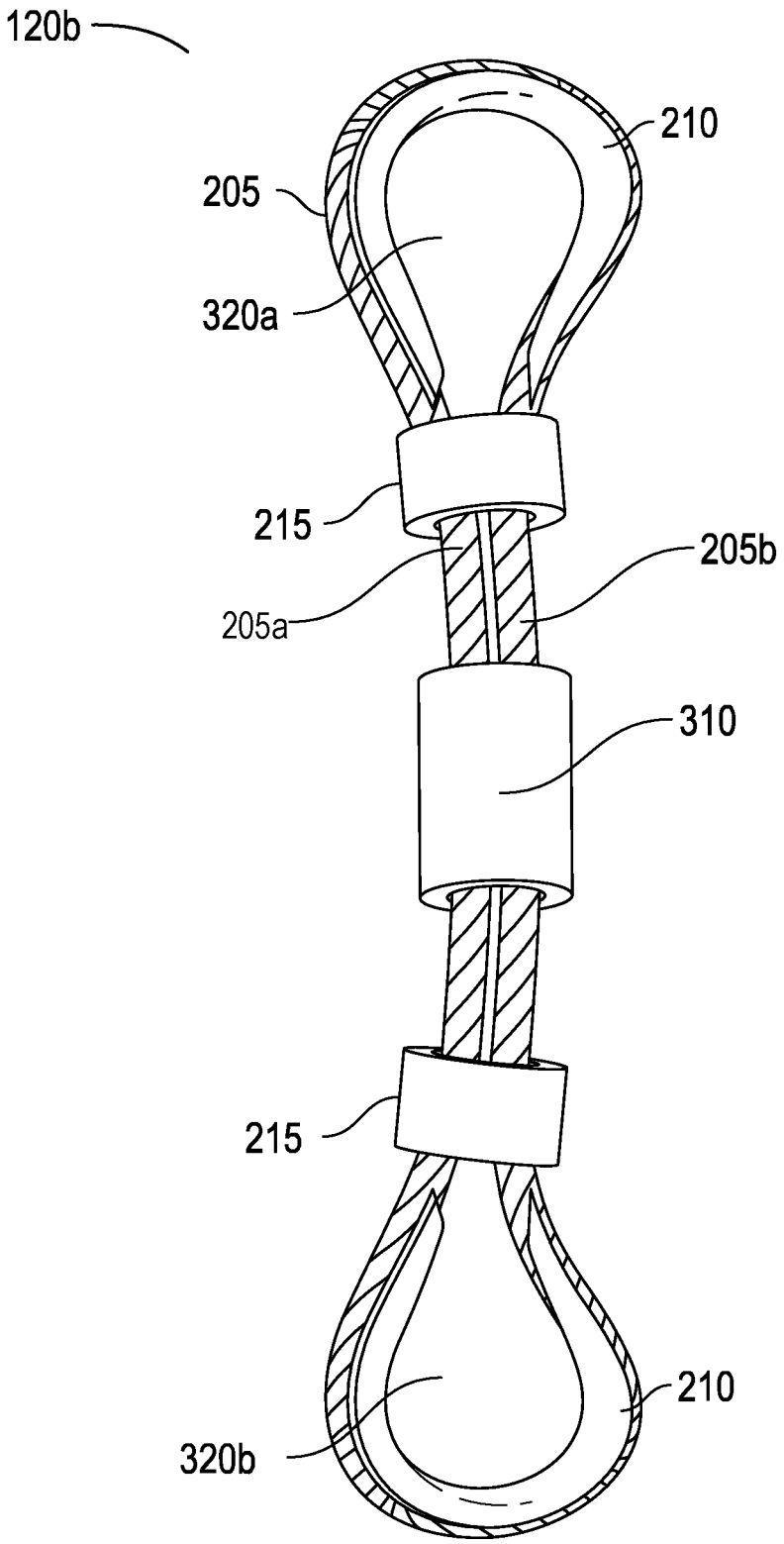
FIG. 3 illustrates an exemplary dual strand sling implement, in accordance with an embodiment of the present invention.

FIG. 3 illustrates an exemplary dual strand sling implement 120*b*, in accordance with an embodiment of the present invention. In the present embodiment shown, the dual strand sling implement 120*b* may include but not limited to a dual strand wire rope 205*a* 205*b*, a pair of thimbles 210, a pair of thimble eye compression sleeves 215, and a wire connection compression sleeve 310. A thimble eye 320*a*/320*b* is formed at each end portion of the wire rope 205 held with the compression sleeve 215. Thimbles 210 may be made of steel or various other metals. One thimble eye end 320*a* is for connecting the dual strand sling implement 120*b* to the golf ball 130. The other thimble eye end 320*b* is for connecting the dual strand sling implement 120*b* to the eye strap 135 and the rubber sheet 105. The other thimble eye end 320*b* may be anchored to the middle of the rubber sheet 105 by the eye strap 135. The other thimble eye end 320*b* may allow the attached golf ball 130 to be flexible during use. The thimble eye ends 320*a* 320*b* may protect the wire rope 205 from fraying due to the golf ball's circular rotation after being struck. A proximately six (6) inch or longer dual strand sling implement 120*b* may allow the golf ball 130 to rotate inside a proximately eight (8) inch or more diameter of the grass turf 105.

Figure 4:
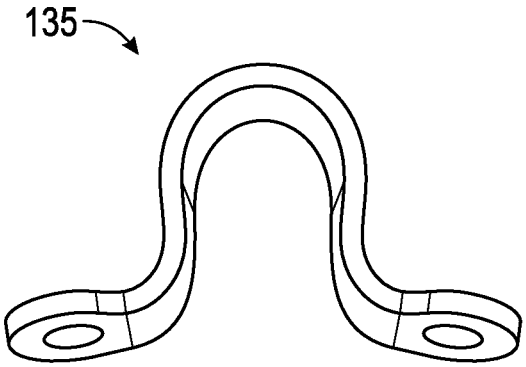
FIG. 4 illustrates an exemplary strap implement, in accordance with an embodiment of the present invention.

FIG. 4 illustrates an exemplary strap implement 135, in accordance with an embodiment of the present invention. In the present embodiment shown, the strap implements 135 may include, but not limited to, a ⅞"×½" stainless steel flat eye strap with a height of about one inch (1"). The approximately one-inch (1") height strap implement 135 may help the attached thimble eye end rotate with less friction around the strap implement 135 when the golf ball 130 is struck by raising the height of the sling implement.

Figure 5:
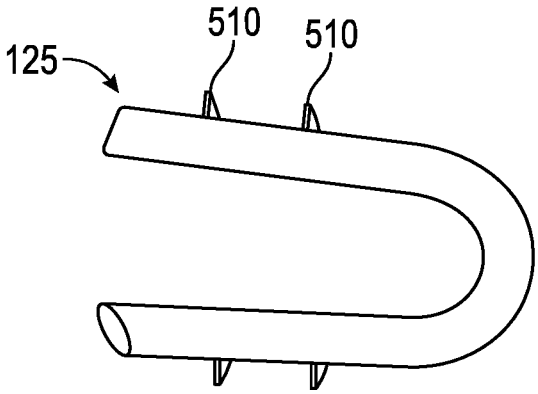
FIG. 5 illustrates an exemplary golf ball fastener, in accordance with an embodiment of the present invention.

FIG. 5 illustrates an exemplary golf ball fastener 125, in accordance with an embodiment of the present invention. In the present embodiment shown, the golf ball fastener 125 may include, but not limited to, a steel double barbed U-shaped golf ball fastener. The double barb 510 at each end of the golf ball fastener 125 may engage the inside of a solid core golf ball to add an extra grip. Additional barbs 510 may be added to further strengthen the fasteners 125 grip on the golf ball 130. In some embodiments, a modified or unmodified double barbed fence staple may be used as the golf ball fastener.

Figure 6:
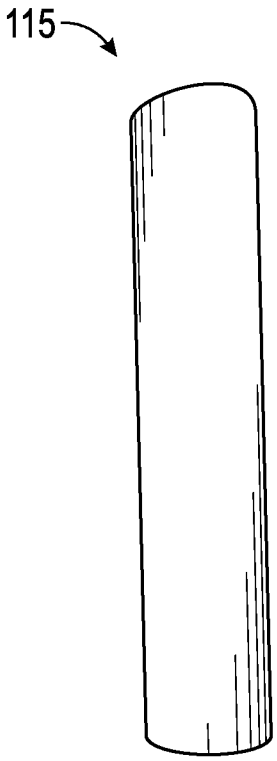
FIG. 6 illustrates an exemplary sling protection tubing, in accordance with an embodiment of the present invention.

FIG. 6 illustrates an exemplary sling protection tubing 125, in accordance with an embodiment of the present invention. In the present embodiment shown, the tubing implement 125 generally encloses the sling implement 120 to protect the sling implement during practice. The tubing may include but not limited to, vinyl, PVC, rubber, etc.

Figure 7:
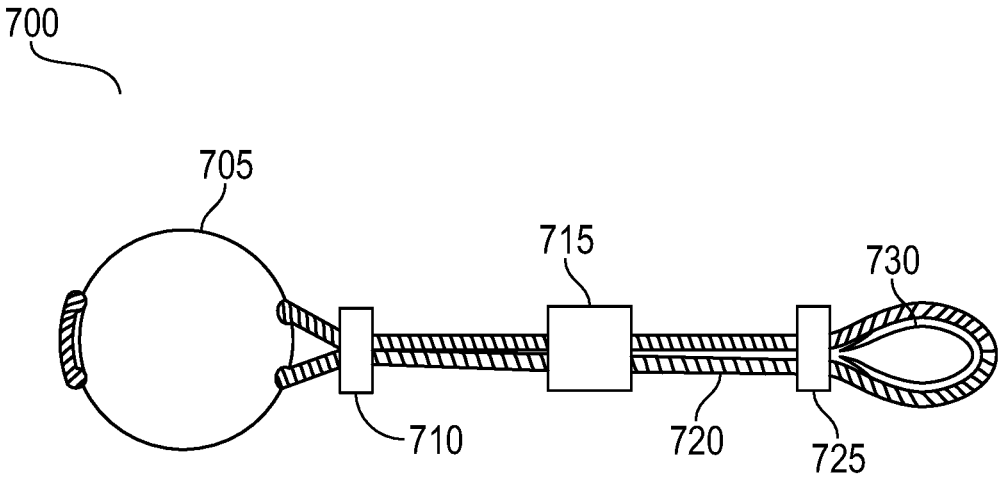
FIG. 7 illustrates an exemplary sling implement, in accordance with an embodiment of the present invention.

FIG. 7 illustrates an exemplary sling implement 700, in accordance with an embodiment of the present invention. In the present embodiment, sling implement 700 comprises golf ball 705 operable for hitting practice, Sling implement 700 may further comprise golf ball attachment eye segment 707, first and second compression sleeves 710 and 725, wire connection compression sleeve 715, wire/cable assembly 720, wire/cable eye 735, and wire/cable eye thimble 730. First compression sleeve 710, second compression sleeve 725 and wire connection compression sleeve 715 may be copper sleeves. One skilled in the art will recognize that material other than copper may be used to form compression sleeves 710 and 725, such as, but not limited to, aluminum, steel, plastic, or any other material known in the art. Cable assembly 720 is configured to be operable for retaining golf ball 705 during the hitting practice. Cable assembly 720 may be comprised of a ⅛"×6" 7×19 galvanized wire rope. One skilled in the art will recognize that cable assembly 720 may be formed of other materials, such as, but not limited to, nylon rope, bungee cord, solid core bungee cord, flat bungee cord, chains, or any other material known in the art. Further, cable 720 may be of a different diameter and length and is not limited to ⅛"×6" 7×19. A first end portion of cable assembly 720, configured as golf ball attachment eye 707, engages golf ball 705. The first end portion of cable 720 and an upper mid-portion of cable 720 may be inserted into compression sleeve 710 and crimped in place to form the engagement between golf ball attachment eye 707 and golf ball 705. The other end portion of cable 720 and a lower mid-portion of cable 720 may be inserted into compression sleeve 725 and crimped in place to form cable eye 735 for engagement with a stationary object such as but not limited to an eye strap. The addition of cable eye thimble 730 protects cable eye 735 by guiding cable eye 735 into a natural curve and creating an extra layer of support. Cable eye thimble eye 730 may be comprised of steel and may further be used to prevent cable eye 735 from fraying due to the circular rotation of golf ball 705 after being struck. One skilled in the art will recognize that cable eye thimble 730 may be formed of other materials, such as copper, aluminum, stainless steel, or any other material known in the art. Wire connection compression sleeve 715 may be used to tie loose ends of cable assembly 720 where the loose ends of cable assembly 720 is inserted into wire connection compression sleeve 715 and crimped in place.

Figure 8A:
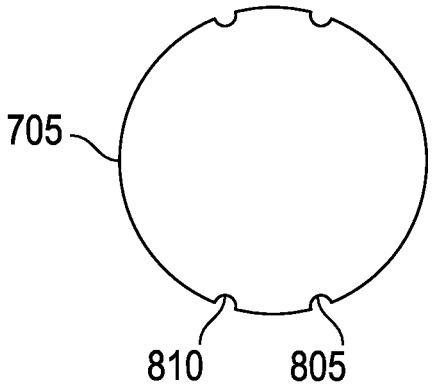
FIGS. 8A-8B illustrates an exemplary golf ball, in accordance with an embodiment of the present invention.
Figure 8B:
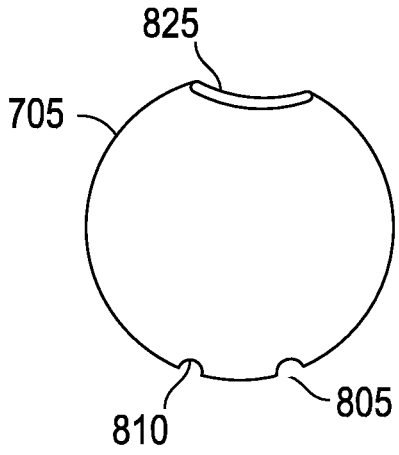

FIGS. 8A-8B illustrate an exemplary golf ball, in accordance with an embodiment of the present invention. Referring now to both FIG. 7 and FIG. 8A, holes 805 and 810 are drilled into golf ball 705. Holes 805 and 810 may be approximately 5/32" in diameter and approximately ⅜" apart but may be of any diameter and distance apart depending on the needs of the user and the material used for cable 720. Referring now to both FIG. 7 and FIG. 8B, slot 825 is made on either end of golf ball 705, connecting holes 805 and 810. Slot 825 may be created using a 5/32" drill bit and drilling multiple holes in a line between holes 805 and 810 until slot 825 is formed. Additionally, Slot 825 may be about ⅛" deep to allow adequate space for cable 720, as will be shown below. One skilled in the art will appreciate that slot 825 may be created using alternative methods including, but not limited to, milling, cutting etc. Slot 825 may be of any depth and width as required by the user and depending on the material of cable 720 and may not be limited to being 5/32" wide and ⅛" deep.

Figure 9A:
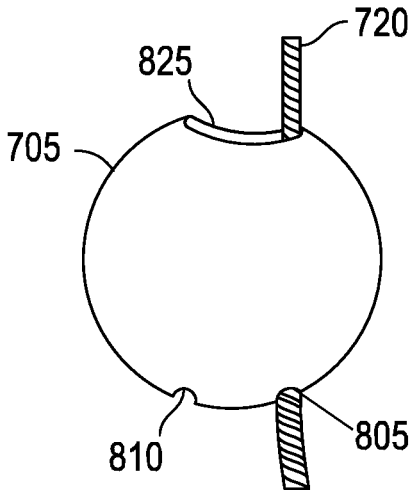
FIG. 9A-9C illustrate an exemplary golf ball with cable attached, in accordance with an embodiment of the present invention.
Figure 9C:
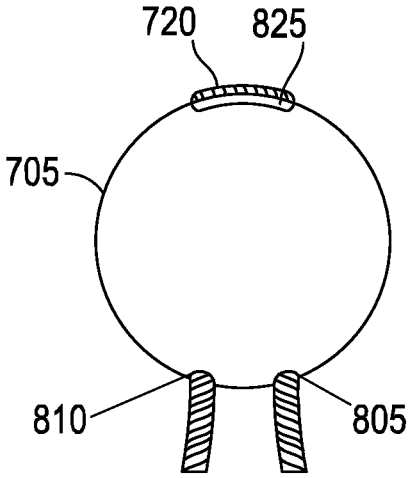
Figure 9B:
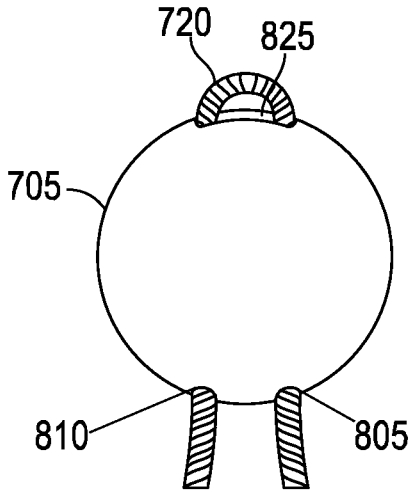

FIGS. 9A-9C illustrate an exemplary golf ball with cable attached, in accordance with an embodiment of the present invention. Referring now to both FIG. 7 and FIG. 9A, cable 720 may be inserted into hole 805 through golf ball 705. It should be noted that cable 720 may be inserted into either hole 805 or 810. Referring now to both FIG. 7 and FIG. 9B, cable 720 may be subsequently inserted in hole 810 through golf ball 705. Referring now to both FIG. 7 and FIG. 9C, both ends of cable 720 may be pulled so that cable 720 is inserted into slot 825.

Figure 10A:
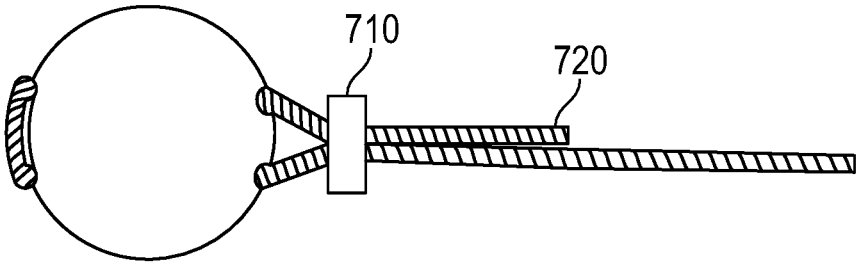
FIG. 10A-10C illustrate an exemplary golf ball with an exemplary sling implement, in accordance with an embodiment of the present invention.
Figure 10B:
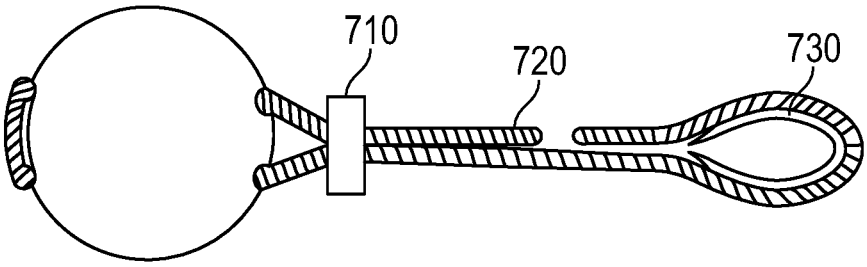
Figure 10C:
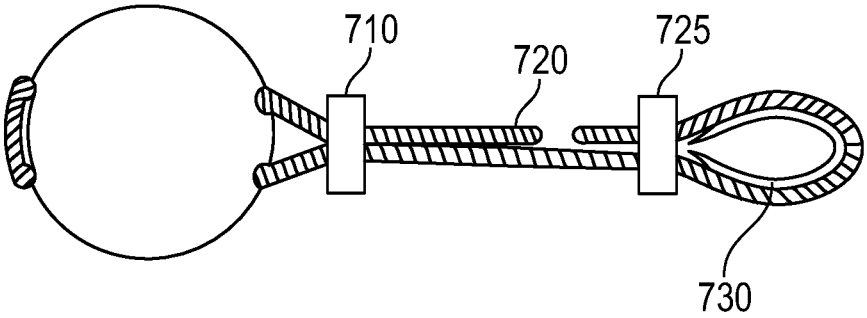

FIGS. 10A-10C illustrate an exemplary golf ball with an exemplary sling implement, in accordance with an embodiment of the present invention. Referring now to both FIG. 7 and FIG. 10A, a copper sleeve may be cut in half to form compression sleeve 710. As discussed above, compression sleeve 710 may be formed from copper sleeve, but may be formed from various other materials as desired by the user. Cable 720 may be inserted into compression sleeve 710 and crimped in place. Referring now to both FIG. 7 and FIG. 10B, cable eye thimble 730 may be inserted on one end of cable 720, at cable eye 735. Referring now to both FIG. 7 and FIG. 10C, additional compression sleeve 725, may be formed from the other half of the copper sleeve used to form compression sleeve 710, may be inserted near cable eye 735 and cable eye thimble 730 and crimped in place.

Figure 11A:
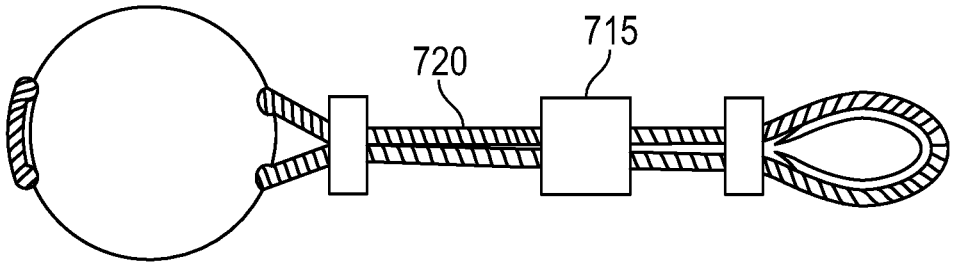
FIG. 11A-11B illustrate an exemplary golf training device with sling protection tubing, in accordance with an embodiment of the present invention.
Figure 11B:
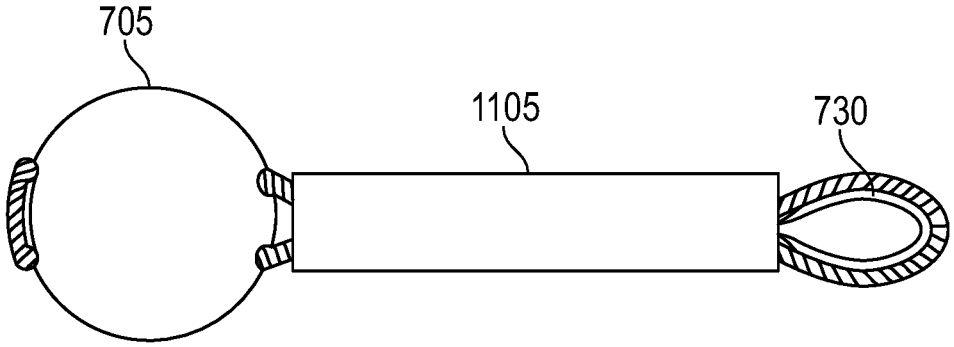

FIGS. 11A-11B illustrate an exemplary golf training device with sling protection tubing, in accordance with an embodiment of the present invention. Referring now to both FIG. 7 and FIG. 11A, wire connection compression sleeve 715 may be inserted on to the loose end of cable 720 and crimped in place. Referring now to both FIG. 7 and FIG. 11B, sling protection tubing 1105 may be inserted onto sling implement 700 between golf ball 705 and cable eye thimble 730 and is used to protect sling implement 700 while in use. One skilled in the art will appreciate that sling protection tubing 1105 may be formed from any material such as, but not limited to, vinyl, PVC, and rubber.

Figure 12A:
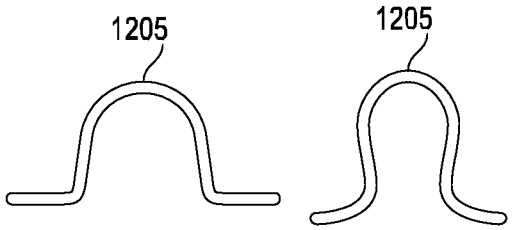
FIG. 12A-12B illustrate an exemplary eye strap and an exemplary wire thimble, in accordance with an embodiment of the present invention.
Figure 12B:
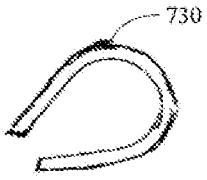

FIGS. 12A-12B illustrate an exemplary eye strap and an exemplary wire thimble, in accordance with an embodiment of the present invention. Referring now to both FIG. 7 and FIG. 12A, eye strap 1205 may include, but not limited to, a ⅞"×½" stainless steel flat eye strap. Eye strap 1205 may be compressed until it rises to approximately 1" in height. The approximately 1" height eye strap 1205 may help the attached cable eye 735 and thimble eye end rotate with less friction around the eye strap 1205 when the golf ball 705 is struck by raising the height of sling implement 700. As will be appreciated by one skilled in the art, eye strap 1205 may be formed of any material, and may be compressed to various other different heights depending on the needs of the user. Referring now to both FIG. 7 and FIG. 12B, cable eye thimble 730 may be comprised of steel, and is used to prevent cable eye 735 from fraying due to the circular rotation of golf ball 705 after being struck. One skilled in the art will recognize that cable eye thimble 730 may be formed of other materials, such as copper, aluminum, stainless steel, or any other material known in the art.

Figure 13A:
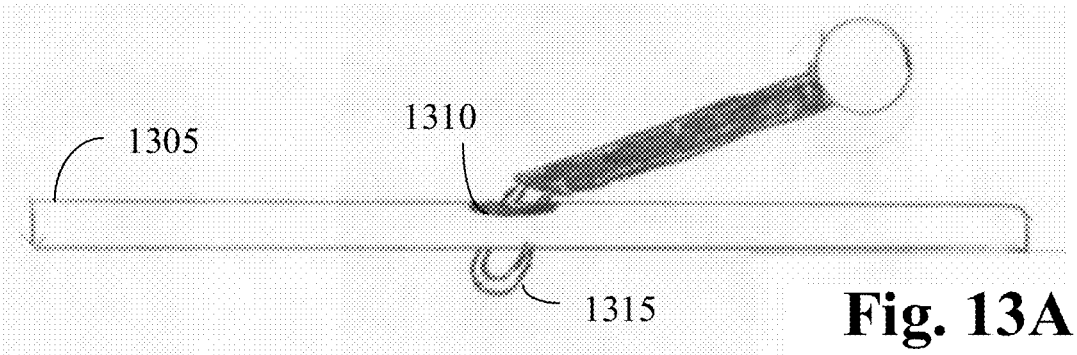
FIG. 13A-13D illustrate an exemplary method of assembling golf training device, in accordance with an embodiment of the present invention.
Figure 13B:
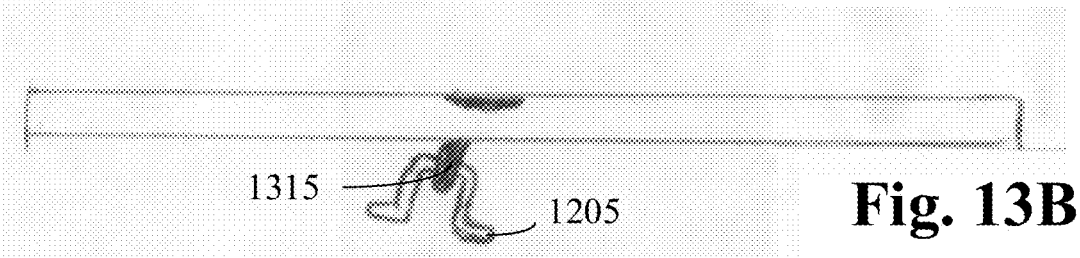
Figure 13C:
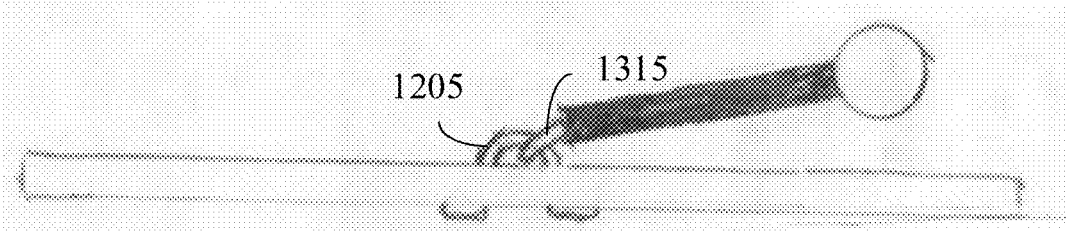
Figure 13D:
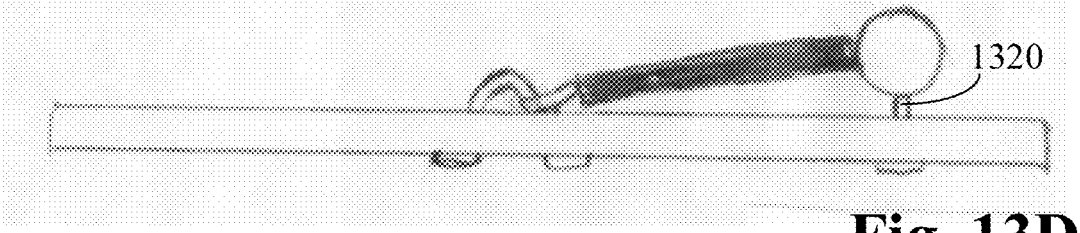

FIGS. 13A-13D illustrate an exemplary method of assembling golf training device, in accordance with an embodiment of the present invention. Referring now to FIG. 13A, end loop 1315 may be inserted through center hole 1310 of rubber sheet 1305. Rubber sheet 1305 may be formed of rubber and may be about 12" by 12" by ½". As will be appreciated by one skilled in the art, rubber sheet 1305 may be made of any material such as, but not limited to, Poly Vinyl Chloride (PVC) board, plastics, wood, and metals, and have different dimensions depending on the needs of the user in practicing a golf tee shot. Referring now to both FIG. 12A and FIG. 13B, eye strap 1205 may be inserted into end loop 1315 or cable eye 735. Referring now to both FIG. 12A and FIG. 13C, eye strap 1205 may be pushed up through center hole 1310. Referring now to FIG. 13D, golf tee 1320 may be inserted into mat base 1305.

Figure 14:
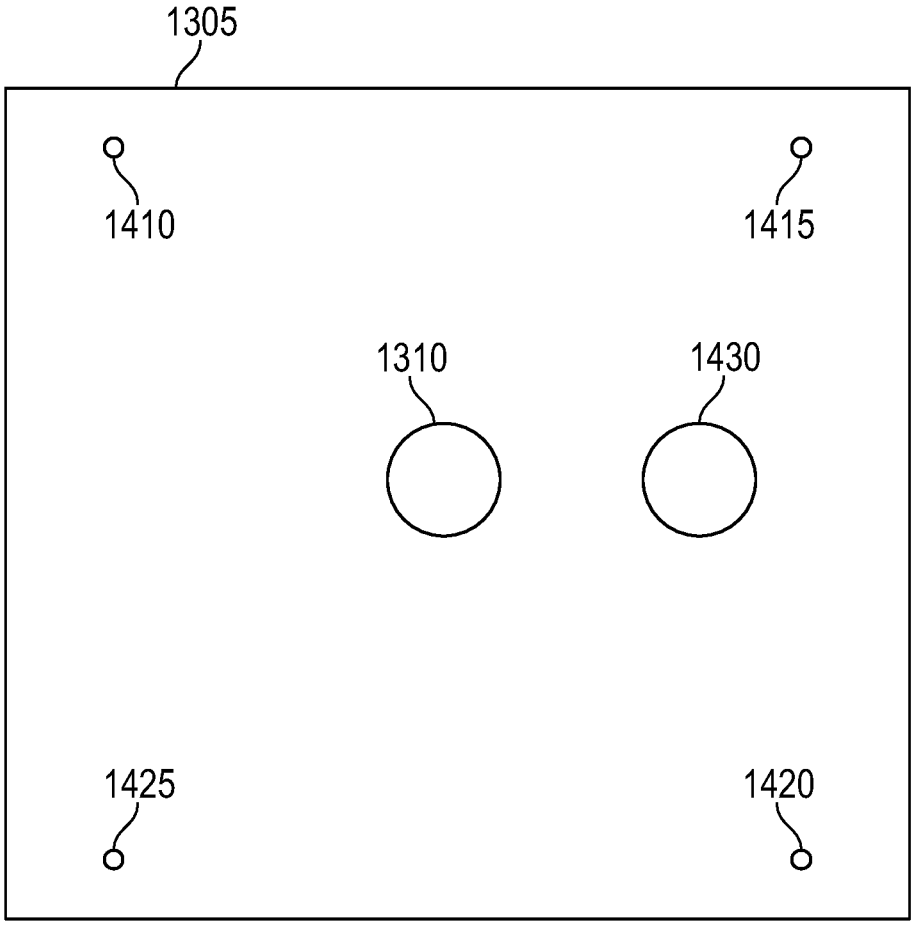
FIG. 14 illustrates an exemplary golf training mat, in accordance with an embodiment of the present invention.

FIG. 14 illustrates an exemplary golf training rubber sheet, in accordance with an embodiment of the present invention. Referring now to both FIG. 13 and FIG. 14, Tie down holes 1410-1425 may be located in the corners of rubber sheet 1305. In the present embodiment, tie down holes 1410-1425 may be placed approximately ½" away from the top and bottom edges, and approximately 1" away from side edges.

Additionally, tie down holes 1410-1425 may be about 5/16" in diameter. As will be appreciated by one skilled in the art tie down holes 1410-1425 may be in any different location on rubber sheet 1305, and may be of any diameter, and may be greater or fewer in number, depending on the needs of the user. Center hole 1310 may be located in the center of rubber sheet 1305 and may be about ¾" in diameter. Golf tee hole 1430 may be located approximately 2" from the side edge of rubber sheet 1305 and may be about ¾" in diameter. As will be appreciated by one skilled in the art, center hole 1310 and golf tee hole 1430 may be of any diameter and may be located anywhere on rubber sheet 1305.

Figure 15:
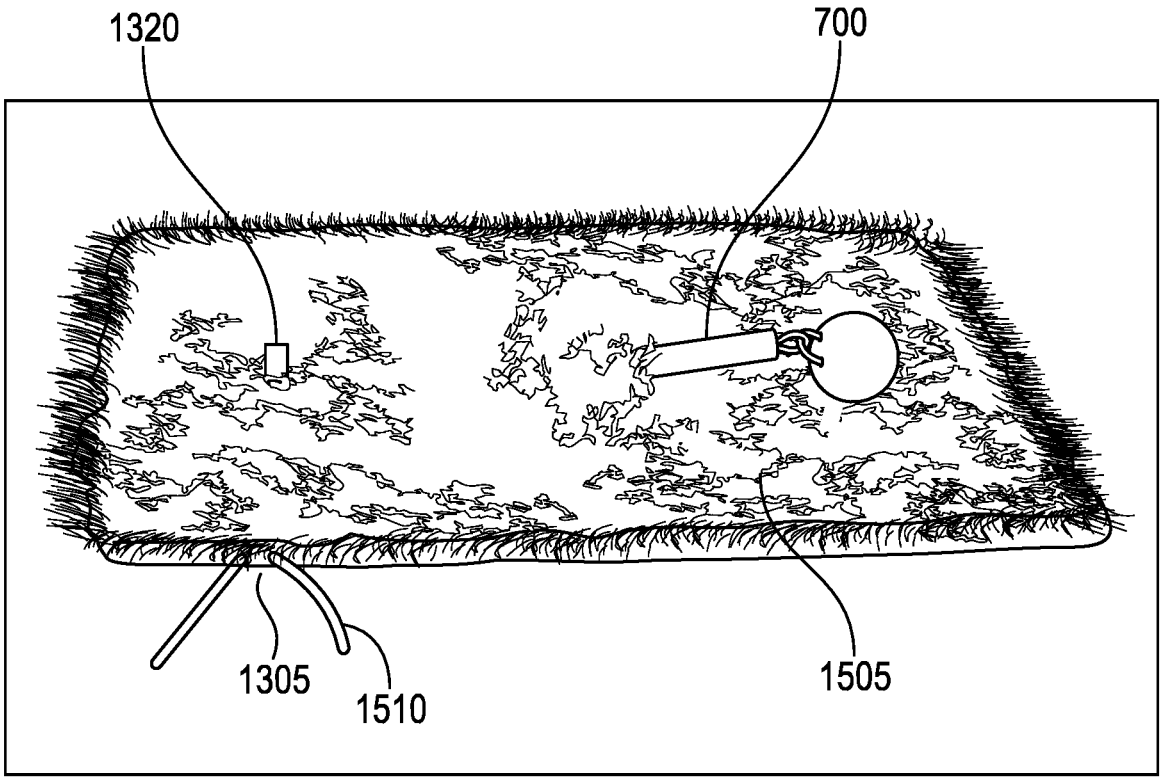
FIG. 15 illustrates an exemplary golf training device, in accordance with an embodiment of the present invention.

FIG. 15 illustrates an exemplary golf training device, in accordance with an embodiment of the present invention. Referring now to FIG. 7, FIGS. 13A-13D, and FIG. 15, artificial turf 1505 is secured to rubber sheet 1305 via tie downs 1510. Artificial turf 1505 may be of any type, such as but not limited to nylon, polyethylene, and polypropylene, any pile height, and any color. Additionally, tie downs 1510 may be of any material, such as rubbers, plastics, metals, etc. One skilled in the art will appreciate that other means of securing artificial turf 1505 to rubber sheet 1305 may be used, such a s but not limited to, staples, stitching, nuts and bolts, adhesive, etc. Slings implement 700 and golf tee 1320 are attached to rubber sheet 1305 and artificial turf 1505 as described above, with reference to FIGS. 13A-13D.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. For any method steps described in the present application that can be carried out on a computing machine, a typical computer system can, when appropriately configured or designed, serve as a computer system in which those aspects of the invention may be embodied.

All the features disclosed in this specification, including any accompanying abstract and drawings, may be replaced by alternative features serving the same, equivalent, or similar purpose, unless expressly stated otherwise. Thus, unless expressly stated otherwise, each feature disclosed is one example only of a generic series of equivalent or similar features.

It is noted that according to USA law 35 USC § 112 (1), all claims must be supported by sufficient disclosure in the present patent specification, and any material known to those skilled in the art need not be explicitly disclosed. However, 35 USC § 112 (6) requires that structures corresponding to functional limitations interpreted under 35 USC § 112 (6) must be explicitly disclosed in the patent specification. Moreover, the USPTO's Examination policy of initially treating and searching prior art under the broadest interpretation of a "mean for" or "steps for" claim limitation implies that the broadest initial search on 35 USC § 112(6) (post AIA 112(f)) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC § 112(6) (post AIA 112(f)) when such corresponding structures are not explicitly disclosed in the foregoing patent specification. Therefore, for any invention element(s)/structure(s) corresponding to functional claim limitation(s), in the below claims interpreted under 35 USC § 112(6) (post AIA 112(f)), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claim's construction proceedings and/or examination of patent allowability properly identify and incorporate only the portions of each of these documents discovered during the broadest interpretation search of 35 USC § 112(6) (post AIA 112(f)) limitation, which exist in at least one of the patents and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3rd parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC § 112(6) (post AIA 112(f)), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC § 112 (6). Applicant(s) note that all the identified documents above which are incorporated by reference to satisfy 35 USC § 112 (6) necessarily have a filing and/or publication date prior to that of the instant application, and thus are valid prior documents to incorporated by reference in the instant application.

Having fully described at least one embodiment of the present invention, other equivalent or alternative methods of implementing but not limited to golf practicing aid devices according to the present invention will be apparent to those skilled in the art. Various aspects of the invention have been described above by way of illustration, and the specific embodiments disclosed are not intended to limit the invention to the particular forms disclosed. The particular implementation of the golf practicing aid devices may vary depending upon the particular context or application. By way of example, and not limitation, the golf practicing aid device described in the foregoing were principally directed to golf implementations; however, similar techniques may instead be applied to but not limited to hockey, cricket, field hockey, etc., which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The Abstract is provided to comply with 37 C.F.R. Section 1.72(b) requiring an abstract that will allow the reader to ascertain the nature and gist of the technical disclosure. That is, the Abstract is provided merely to introduce certain concepts and not to identify any key or essential features of the claimed subject matter. It is submitted with the understanding that it will not be used to limit or interpret the scope or meaning of the claims.

The following claims are hereby incorporated into the detailed description, with each claim standing on its own as a separate embodiment.

What is claimed is:

1. A device comprising:

a golf ball that is configured to be operable for golf hitting practice, said golf ball comprises a first connecting hole and a second connecting hole;

a cable assembly, said cable assembly is configured to retain said golf ball during said golf hitting practice;

a golf ball attachment eye segment, said golf ball attachment eye segment is configured to engage said first and second connecting hole of said golf ball;

a first compression sleeve, wherein said first compression sleeve is configured to join a portion of said cable assembly that is forming said golf ball attachment eye engaged with said golf ball;

an artificial grass turf that is configured for said golf hitting practice;

at least one eye strap, wherein said at least one eye strap is configured to engage said cable assembly;

a cable eye segment, said cable eye segment is configured to be operable for engaging said artificial grass turf with said at least one eye strap; and a second compression sleeve wherein said second compression sleeve is configured to join a portion of said cable assembly that is forming said cable eye segment.

2. The device of claim 1, further comprising a wire connection compression sleeve that is configured to tie loose ends of said cable assembly.

3. The device of claim 2, further comprising a cable thimble eye tool that is configured to protect said cable eye segment from fraying.

4. The device of claim 3, further comprising a sling protection tubing, wherein said sling protection tubing is configured to protect said first, second, and wire connection compression sleeves.

5. The device of claim 4, further comprising at least one of a rubber sheet laden with said artificial grass turf with a center hole, said eye strap being configured to be operable for engaging said center hole.

6. The device of claim 5, wherein said eye strap comprises a compressed portion having a predetermined height that is configured to engage said cable eye segment.

7. The device of claim 1, wherein said golf ball comprises a slot portion that is configured to engage said golf ball attachment eye segment, to retain said golf ball during said hitting practice.

8. The device of claim 7, wherein said artificial grass turf comprises a rubber, vinyl, or plastic sheet that is configured to be operable for golf hitting practice.

9. The device of claim 8, wherein said rubber, vinyl, or plastic sheet comprises an end loop inserted in the center hole, and wherein said end loop is configured to accept said at least one eye strap.

10. The device of claim 1, wherein said first and second connecting holes are configured to engage said golf ball attachment eye segment, to retain said golf ball during said hitting practice.

11. A method for a golf hitting practice consisting the steps for:

retaining a golf ball with a cable assembly during said golf hitting practice, said cable assembly comprises loose ends;

engaging said golf ball with a golf ball attachment eye segment;

joining a portion of said cable assembly that is forming said golf ball attachment eye to be engaged with said golf ball;

engaging a cable eye segment with an artificial grass turf;

tying the loose ends of said golf ball cable assembly with a wire connection compression sleeve;

protecting at least one of the loose ends of said cable assembly from fraying with a cable thimble eye tool; and protecting said cable assembly with a sling protection tubing.

12. A device comprising:

a golf ball that is configured to be operable for golf hitting practice;

a cable assembly, said cable assembly comprises loose ends, wherein said cable assembly is configured to retain said golf ball during said golf hitting practice;

a golf ball attachment eye segment, said golf ball attachment eye segment is configured to engage said golf ball;

a first compression sleeve, wherein said first compression sleeve is configured to join a portion of said cable assembly that is forming said golf ball attachment eye engaged with said golf ball;

an artificial grass turf that is configured for said golf hitting practice;

a cable eye segment formed from at least one of said loose ends, said cable eye segment is configured to be operable for engaging said artificial grass turf;

a second compression sleeve, wherein said second compression sleeve is configured to join a portion of said cable assembly that is forming said cable eye segment;

a wire connection compression sleeve that is configured to tie at least one of said loose ends of said cable assembly; and a cable thimble eye tool that is configured to protect said cable eye segment from fraying.

13. The device of claim 12, further comprising a sling protection tubing, wherein said sling protection tubing is configured to protect said first, second, and wire connection compression sleeves.

14. The device of claim 13, further comprising an eye strap, said eye strap being configured to be operable for engaging said artificial grass turf segment.

15. The device of claim 14, wherein said eye strap comprises a compressed portion having a predetermined height that is configured to engage said cable eye segment.

16. The device of claim 12, wherein said golf ball comprises a slot portion that is configured to engage said golf ball attachment eye segment, to retain said golf ball during said hitting practice.

17. The device of claim 16, wherein said artificial grass turf comprises a rubber, vinyl, or plastic sheet which comprises a center hole that is configured to accept an eye strap.

18. The device of claim 17, wherein said rubber, vinyl, or plastic sheet comprises a center hole that is configured to accept an eye strap, said eye strap being configured to be operable for engaging said stationary object.

19. The device of claim 12, further comprising a golf ball fastener.

20. The device of claim 19, wherein said golf ball engages said golf ball attachment eye segment with said golf ball fastener.

* * * * *